US006939269B2

(12) United States Patent
Makofsky

(10) Patent No.: US 6,939,269 B2
(45) Date of Patent: Sep. 6, 2005

(54) EXERCISE DEVICE FOR IMPROVING HEAD, NECK, AND SPINAL ALIGNMENT

(76) Inventor: Howard W. Makofsky, 89 Lincoln Ave., Mastic Beach, NY (US) 11951

( * ) Notice: Subject to any disclaimer, the term of this patent is extended or adjusted under 35 U.S.C. 154(b) by 0 days.

(21) Appl. No.: 10/309,673

(22) Filed: Dec. 4, 2002

(65) Prior Publication Data

US 2003/0228955 A1 Dec. 11, 2003

Related U.S. Application Data

(60) Provisional application No. 60/385,677, filed on Jun. 5, 2002.

(51) Int. Cl.[7] ..... A63B 23/025; A61F 5/00

(52) U.S. Cl. ..... 482/10; 602/32

(58) Field of Search ..... 482/10–11, 90, 482/105; 602/32–40; 606/240–242

(56) References Cited

U.S. PATENT DOCUMENTS

| | | | | | |
|---|---|---|---|---|---|
| 221,855 | A | | 11/1879 | Oppenheimer | |
| 1,543,346 | A | | 6/1925 | Titus | |
| 1,556,496 | A | * | 10/1925 | Davis | 482/96 |
| 2,633,124 | A | | 3/1953 | Yellin | |
| 2,674,996 | A | * | 4/1954 | Stowell et al. | 602/36 |
| 2,701,564 | A | | 2/1955 | Wilhelm | |
| 3,105,489 | A | * | 10/1963 | Zivi | 602/32 |
| 3,654,922 | A | * | 4/1972 | Outcalt | 602/36 |
| 3,695,256 | A | * | 10/1972 | Brower | 602/32 |
| 3,750,658 | A | | 8/1973 | Dawson | |
| 3,871,366 | A | * | 3/1975 | Cotrel | 602/33 |
| 4,111,415 | A | | 9/1978 | Reitano | |
| 4,674,485 | A | * | 6/1987 | Swanson | 602/33 |
| D344,135 | S | | 2/1994 | Price | |
| 5,505,677 | A | * | 4/1996 | Hinds | 482/10 |
| 5,893,818 | A | | 4/1999 | Zahiri | |

* cited by examiner

*Primary Examiner*—Jerome W. Donnelly
*Assistant Examiner*—Fenn C. Mathew
(74) *Attorney, Agent, or Firm*—Galgano & Burke, LLP

(57) ABSTRACT

An exercise device for improving head, neck, and spinal alignment preferably includes a bracket having a pair of spaced apart pulleys and a U-shaped base which is adapted to fit over a door, a rope having at least one hand grip attached to one end and a coupler attached to the other end, and a head harness having at least one coupler for mating with the coupler on the rope. The apparatus is used by coupling the bracket to a door, attaching the harness to the user's head and coupling the rope to the harness. From either a standing or sitting position, the user pulls on the hand grip(s) to effect a lifting of the harness. According to the presently preferred embodiment, the location of the pulleys is adjustable to suit the user and the harness is provided with both front and rear couplers.

20 Claims, 9 Drawing Sheets

EXERCISE DEVICE FOR IMPROVING HEAD, NECK, AND SPINAL ALIGNMENT

This application claims the benefit of provisional application Ser. No. 60/385,677 filed Jun. 5, 2002, the complete disclosure of which is hereby incorporated by reference herein.

BACKGROUND OF THE INVENTION

1. Field of the Invention

The invention relates to exercise and therapeutic machines. More particularly, the invention relates to the field of exercise and therapeutic machines for head, neck, and spinal alignment.

2. State of the Art

Many people have serious back disorders due to a lack of physical conditioning. Back disorders are caused by one or a combination of poor posture, use of improper body mechanics, stress, lack of proper exercise, poor health, etc. With proper exercise and conditioning, the risk of back injury can be reduced, if not eliminated altogether, by gradually stretching and positioning of the spine to relieve pain and realign the individual vertebrae. Effective exercise provides increased endurance and eliminates muscular problems and range of motion problems.

Proper posture can be effected through passive, active, and resistive exercise. Although the prior art contains many examples of equipment for providing cervical traction to the head and neck, there is no single apparatus which provides all of the recommended exercises to improve posture.

SUMMARY OF THE INVENTION

It is therefore an object of the invention to provide an apparatus for improving head, neck, and spinal alignment.

It is another object of the invention to provide an apparatus for the passive stretching of the posterior cervical/suboccipital muscles.

It is still another object of the invention to provide an apparatus for the active assisted exercise of the deep neck flexor muscles.

It is yet another object of the invention to provide an apparatus for the resistive exercise of the deep neck flexors including isotonic, isokinetic, and isometric exercises.

It is still a further object of the invention to provide an apparatus for the resistive exercise of the mid/lower trapezius and rhomboid muscles.

In accord with these and other objects which will be discussed in detail below, the present invention provides an exercise device for improving head, neck, and spinal alignment comprising: (a) a head harness having a coupling at one of the front of the head and the back of the head; (b) a bracket adapted to be mounted on a support including at least one pulley; and (c) a rope received over said at least one pulley and having a first end and a second end, said first end having at least one hand grip and said second end being releasably coupled to said head harness coupling.

In a preferred embodiment of this invention, the apparatus includes an L-shaped bracket having a pair of spaced-apart pulleys and a U-shaped base which is adapted to fit over a door, a rope having at least one hand grip attached to one end and a coupler attached to the other end, and a head harness having at least one coupler for mating with the coupler on the rope. The apparatus is used by coupling the bracket to a door, attaching the harness to the user's head and coupling the rope to the harness. From either a standing or sitting position, the user pulls on the hand grip(s) to effect a lifting of the harness.

Additional objects and advantages of the invention will become apparent to those skilled in the Art upon reference to the detailed description taken in conjunction with the provided figures.

DETAILED DESCRIPTION OF THE PRESENTLY PREFERRED EMBODIMENTS

Figure 1:
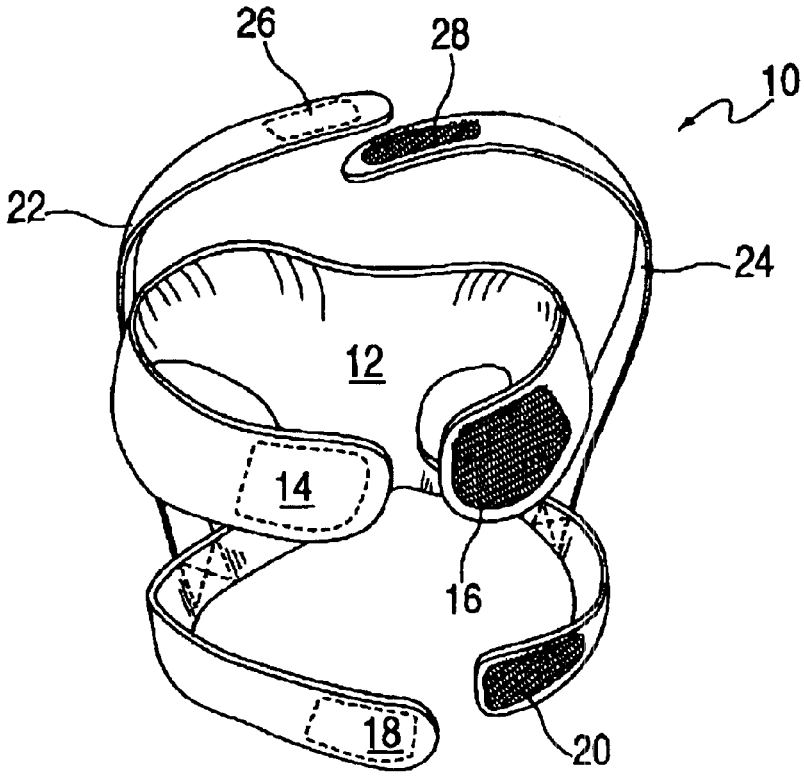
FIG. 1 is a perspective view of a first embodiment of a head harness according to the invention.
Figure 2:
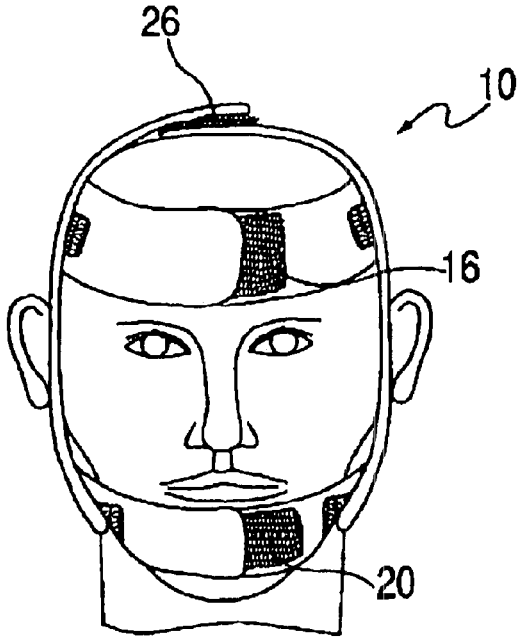
FIG. 2 is a front view of the harness attached to a user's head.
Figure 3:
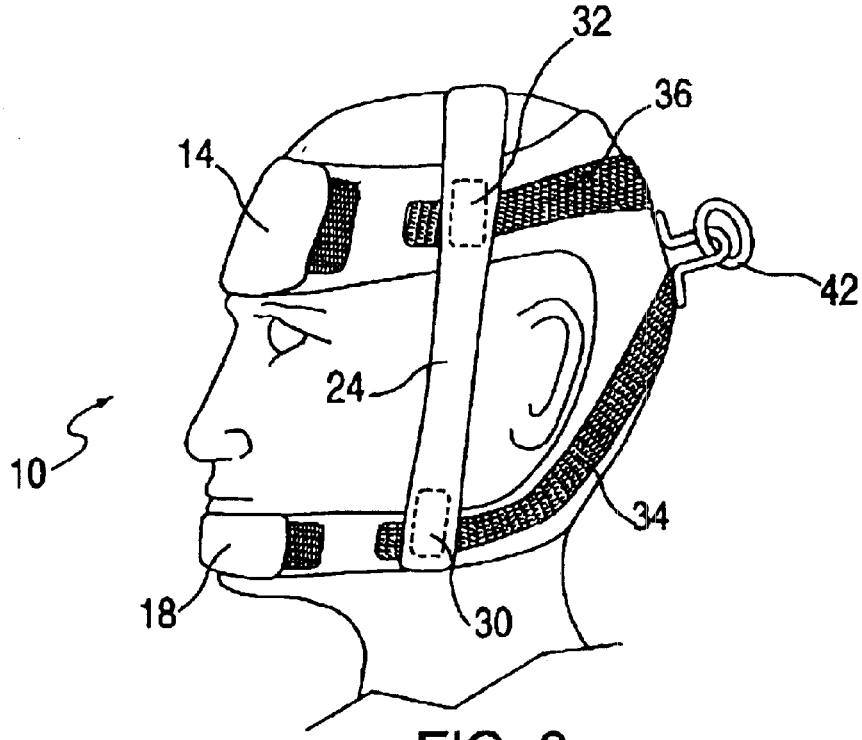
FIG. 3 is a side view of the harness attached to a user's head.
Figure 4:
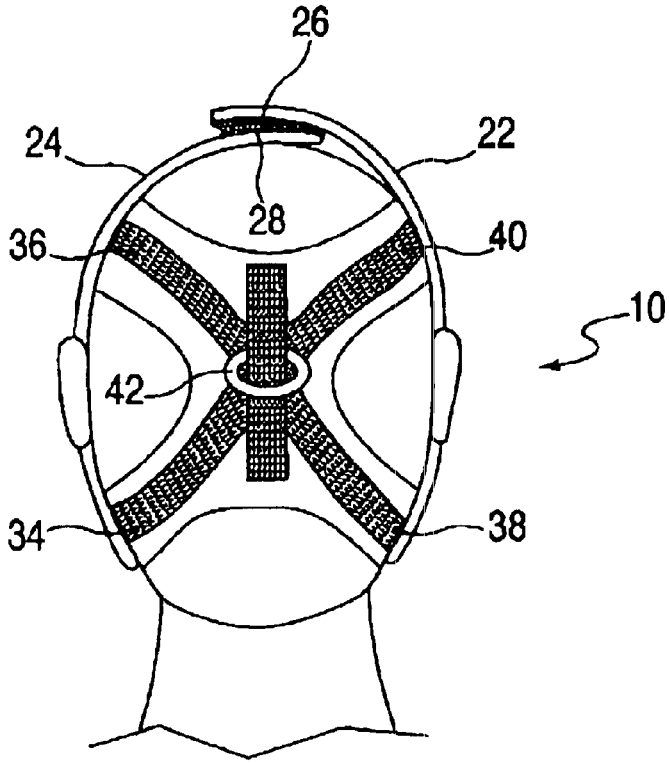
FIG. 4 is a rear view of the harness attached to a user's head.

Turning now to FIGS. 1–4, a first embodiment of a head harness 10 includes an H-shaped (or X-shaped) member 12 having corresponding VELCRO hook and loop fasteners or patches 14, 16, 18, 20 at the extremities and two straps 22, 24 having corresponding VELCRO hook and loop type fasteners or patches 26, 28 at their mating ends. The H-shaped member 12 is dimensioned so that the corresponding hook and loop patches 14 and 16 mate over the forehead of the user while the corresponding hook and loop patches 18 and 20 mate over the chin of the user. As seen here in FIG. 4, the straps 22, 24 are removable from the H-shaped member 12 which is provided with VELCRO strips 34, 36, 38, 40 which are used to attach the straps 22, 24 to the H-shaped member 12. For example, as seen in FIG. 3, the strap 24 is provided with VELCRO patches 30, 32 which mate with strips 34, 36. The straps 22, 24 are dimensioned so that their patches 26, 28 mate on top of the user's head. A coupling ring 42 is provided in the center of the H-shaped member 12 such that it resides on the back of the user's head adjacent the occipital portion of the head (skull) of the intended user. The head harness is designed to conform to the individual's head comfortably and to transfer the lifting forces uniformly across the surface area of the harness.

Figure 6:
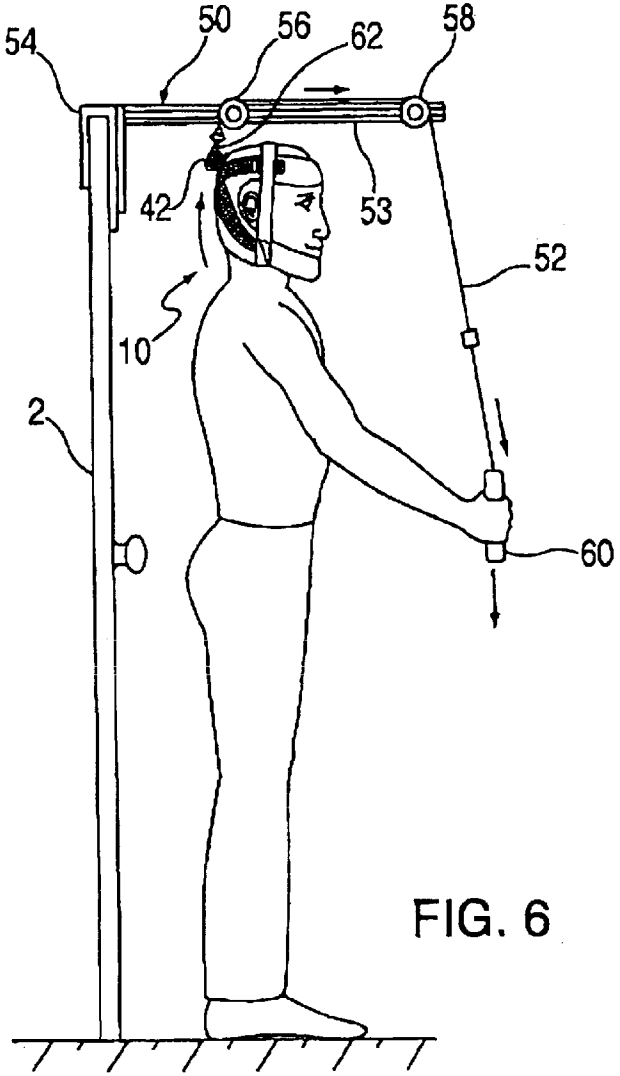
FIGS. 5 and 6 are schematic side views of the first embodiment of the head harness in use with the bracket and rope.
Figure 5:
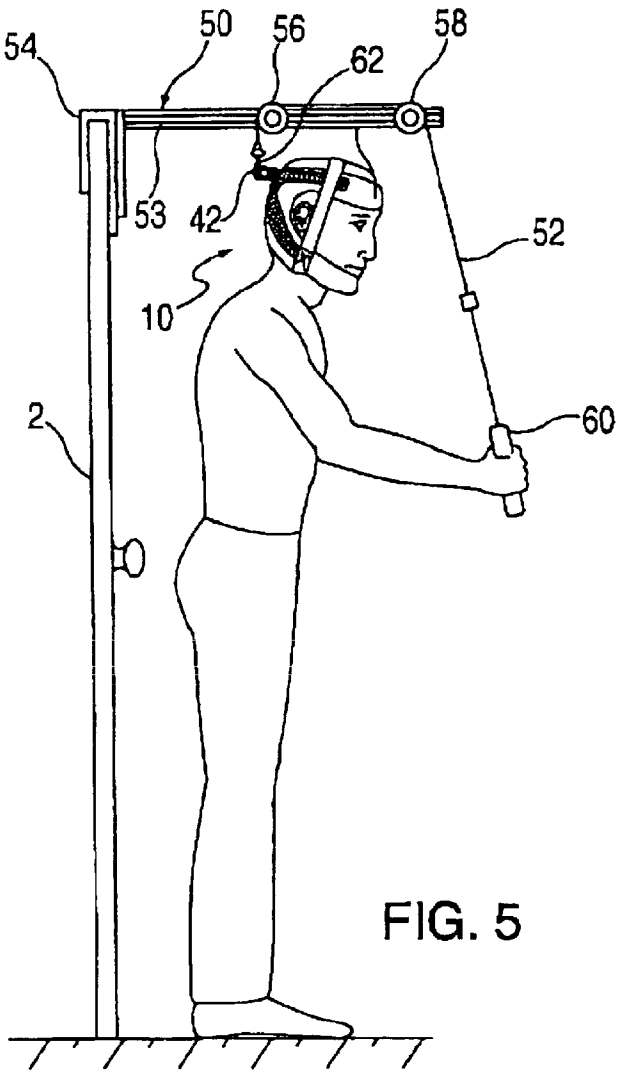

FIG. 5 illustrates the person standing with an improper or poor slouching posture and FIG. 6 illustrates the individual holding an optimal posture position exerting downward pressure on the split rope held in each hand.

FIGS. 5 and 6 illustrate the head harness 10 in conjunction with an L-shaped bracket 50 and a rope 52. The bracket 50 has a U-shaped base 54 which is adapted to fit over the top of a door 2. The horizontal beam 53 of the bracket 50 is provided with two spaced apart pulleys 56, 58. The rope 52 is provided with a pair of hand grips 60 at one end (only of which is shown) and a coupler 62 at the other end. Preferably, coupler 62 is an alligator clip to allow for easy and facile releasable attachment to the head harness. The rope 52 is placed over the pulleys and the coupler 62 is releasably attached to the coupling ring 42 of the head harness. The user grips the hand grips 60 as shown in FIG. 5 and pulls down as shown in FIG. 6 to effect an upward movement of the head. According to the preferred embodiment, the length of the rope 52 is adjustable by means hereinafter described.

Figure 7:
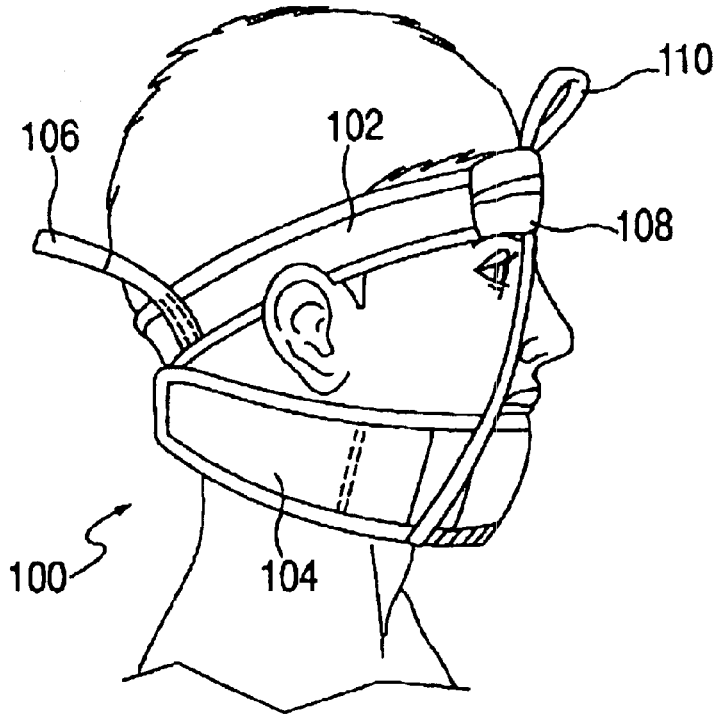
FIG. 7 is a side view of a second embodiment of a head harness according to the invention attached to a user's head.
Figure 8:
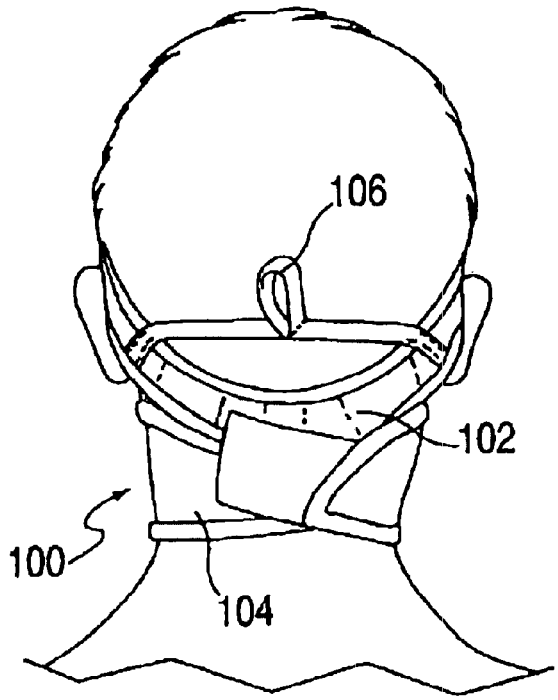
FIG. 8 is a back view of the harness attached to a user's head.
Figure 9:
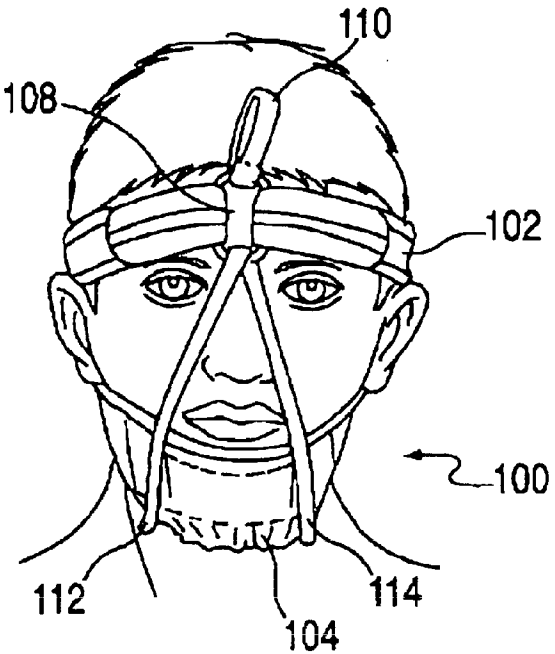
FIG. 9 is a front view of the harness attached to a user's head.

Referring now to FIGS. 7–9, a second embodiment of a head harness 100 is illustrated. The head harness 100 has a forehead strap 102, and a chin strap 104. A first loop coupling 106 is attached to the back of the forehead strap 102 so that it is disposed adjacent to the occipital portion of the head (skull) of the wearer as seen best in FIGS. 7 and 8. A wishbone shaped strap 108 is attached to the front of the forehead strap 102 and the front of the chin strap 104. The wishbone strap 108 has an upper loop coupling 110 which extends from the top of the forehead strap 102 and two descending branches 112, 114 which extend from the forehead strap 102 on opposite sides of the user's nose to the chin strap 104. The upper loop coupling is intended to be disposed adjacent above the wearer's forehead. The straps 102 and 104 are preferably sized and coupled to each other at the back of the user's head using VELCRO hook and loop strips (not shown).

Figure 10:
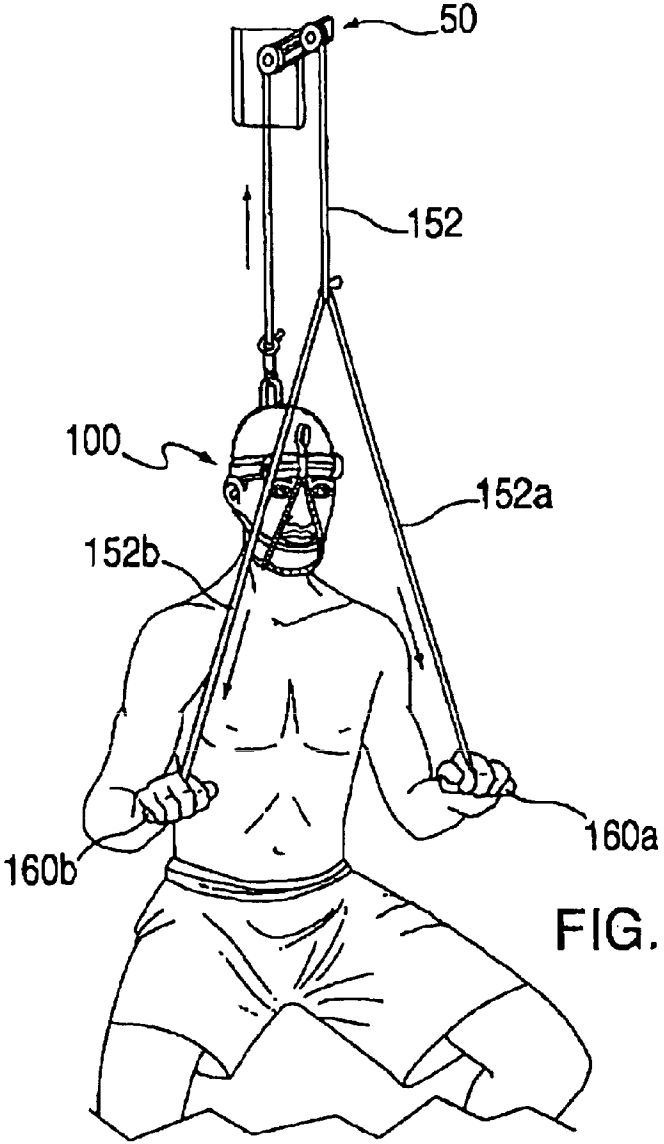
FIGS. 10–12 are schematic perspective views of the second embodiment of the head harness in use with the bracket and rope.
Figure 12:
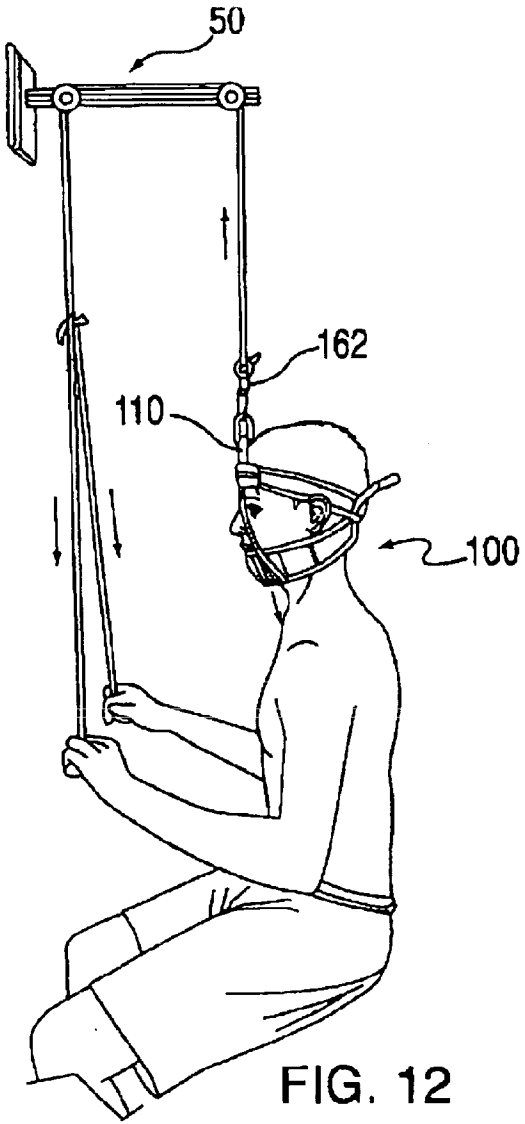
Figure 11:
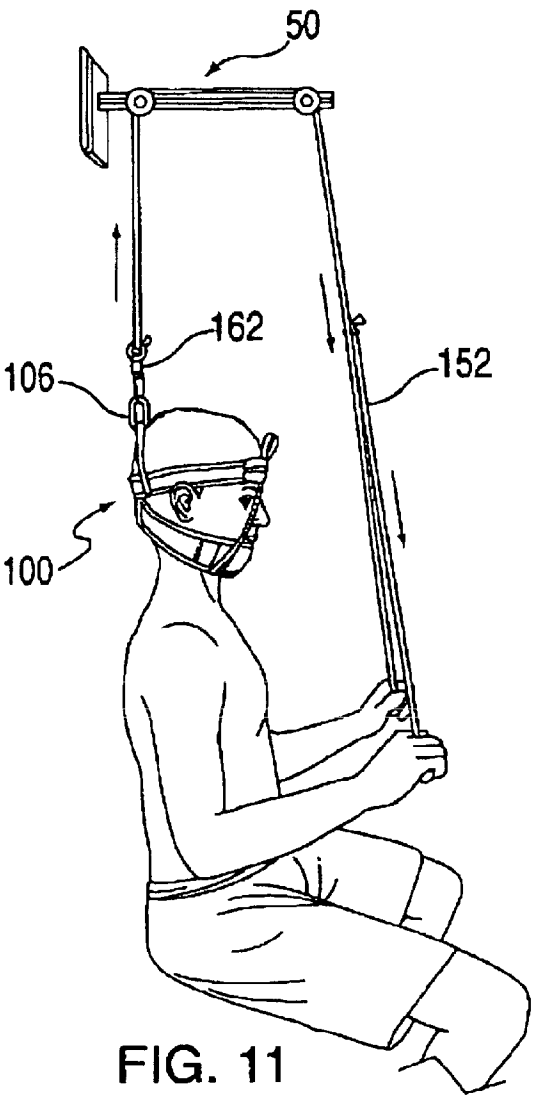

FIGS. 10–12 illustrate the head harness 100 in use with the aforedescribed bracket 50 and a rope 152. However, in this embodiment, the bracket is attached to a plate 51 which, in turn, can be permanently affixed to a door. Of course, either embodiment could be used with the U-shaped base 54 to releasably mount the same on a door, if so desired. The rope 152 is similar to the rope 52 described above. It branches into two parts 152*a,* 152*b* each having a hand grip 160*a,* 160*b,* respectively, As seen in FIGS. 10 and 11, the coupling 162 of the rope can be attached to the rear coupling 106 of the harness 100. As shown in FIG. 12, the coupling 162 of the rope 152 can also be attached to the front coupling 110 of the harness 100. It should be appreciated that although the device is shown with the user in a sitting position, this embodiment as well as the other embodiments can be modified for either sitting or standing positions.

Figure 13:
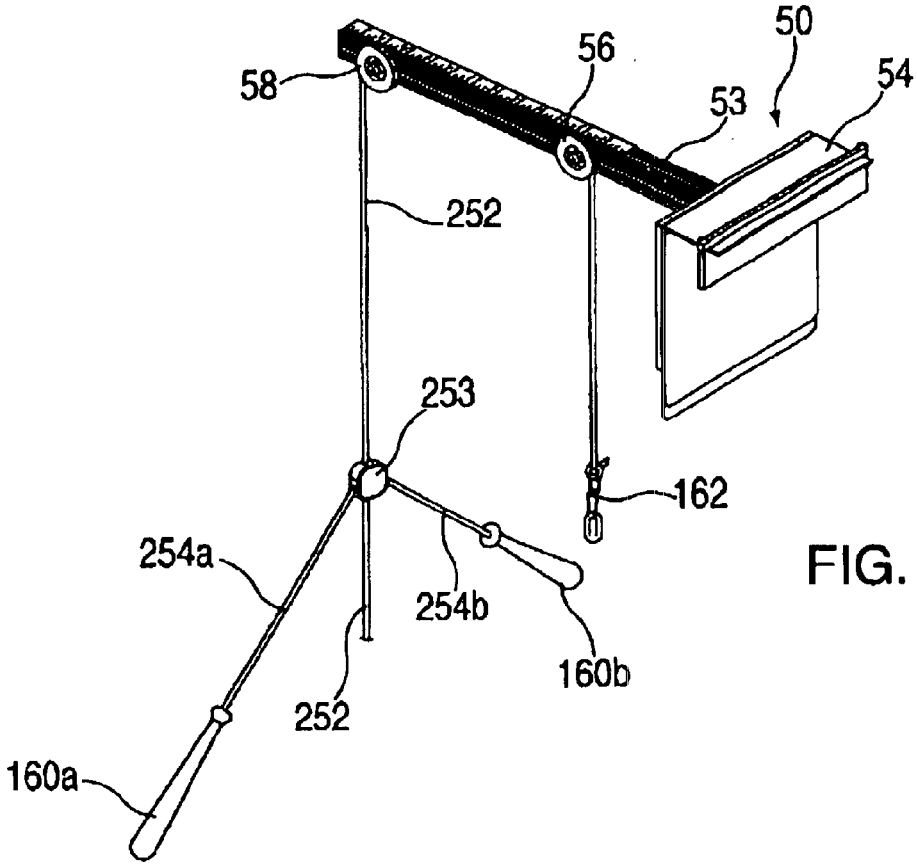
FIGS. 13–17 are perspective views of a presently preferred embodiment of a bracket and rope for use with the head harness.
Figure 14:
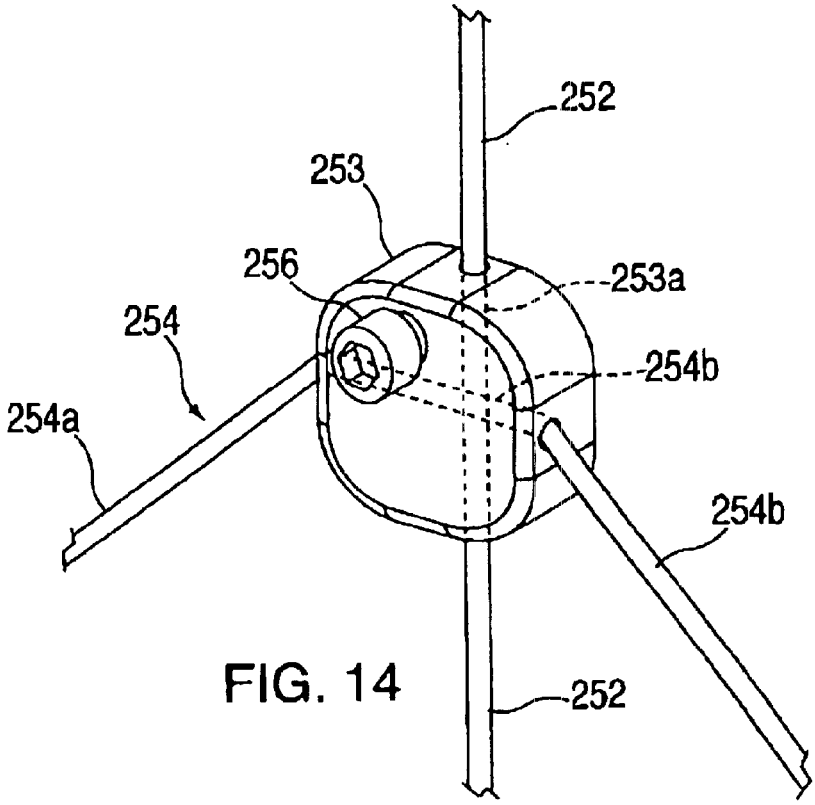

Turning now to FIGS. 13–17, the preferred bracket 50 and presently preferred rope 252 are illustrated in more detail. As seen in FIG. 13, the rope 252 is releasably secured in a vertically-extending bore 253*a* of an adjustable slide block 253 which has the effect of adjusting the overall effective length of rope 252. As seen best in FIG. 14, a rotatable thumb knob 254 is attached to a locking screw (not shown) which, in turn, is threadaly received in a bore for engagement with the bore 253*a* and rope 252. When knob 256 is loosened, slide block 253 is free to slide or to be moved to the desired position on rope 252. The locking screw is tightened against rope 252 via knob 256 to frictionally hold the position. In addition, a handle grip rope 254 is provided which is received through a horizontal-extending bore 253*b* in slide block 253 to define a pair of bifurcated rope segments 254*a* and 252*b* each of which are attached to a handle grip 160*a* and 160*b,* respectively (as seen best in FIG. 13). Adjustable slide block 253 allows the user to change the height of the handle grip bifurcation, thereby compensating for different user heights and various exercise motion ranges.

Figure 15:
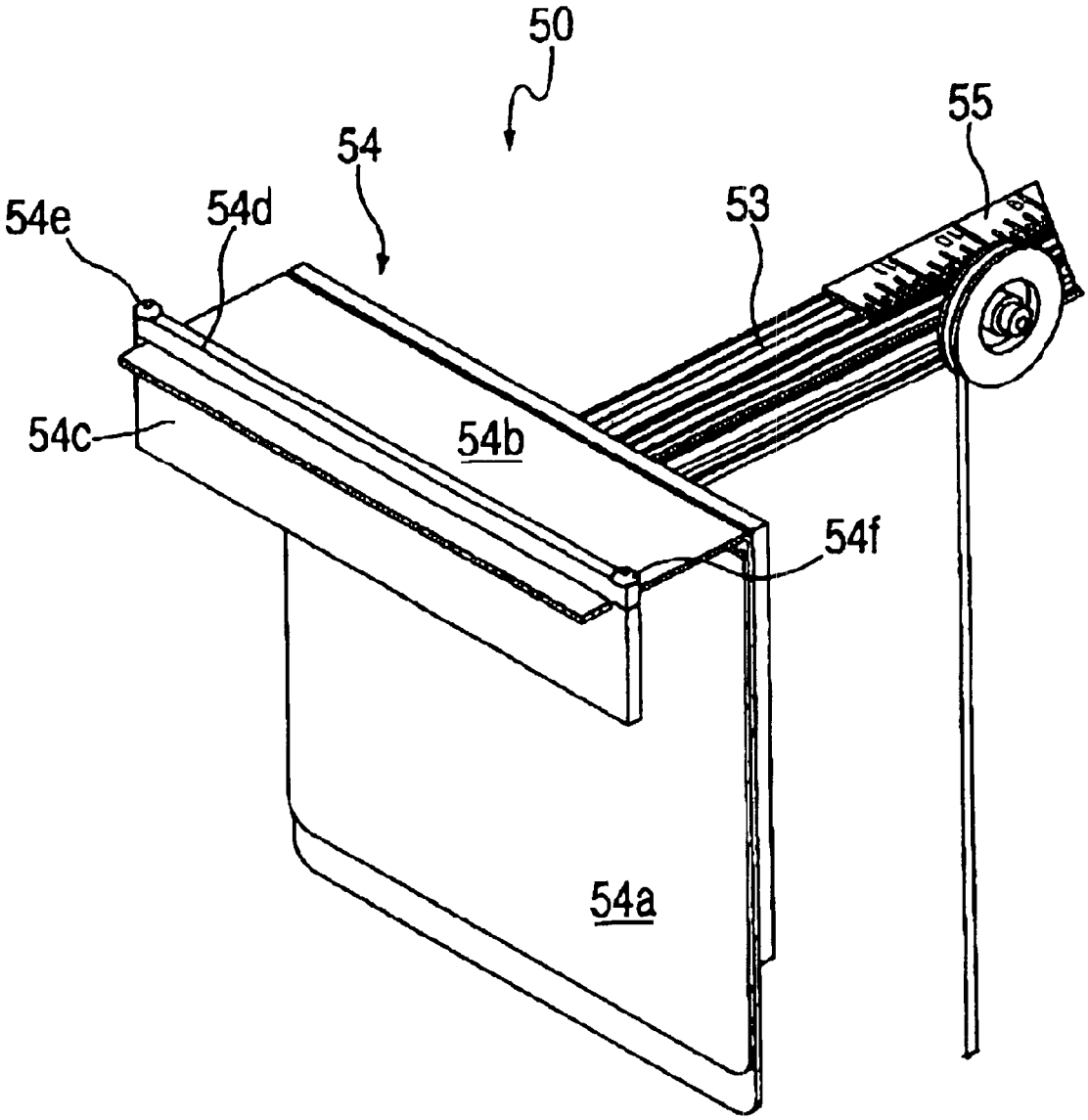

As seen best in FIG. 15, the U-shaped base 54 of the bracket 50 comprises a long vertical member 54*a,* a horizontal member 54*b* and a two part short vertical member 54*c,* 54*d*. The two parts 54*c,* 54*d* are coupled to each other by screws 54*e,* 54*f* to enable their separation to form a slot for receiving member 54*b*. It will thus be appreciated that the distance between the vertical members 54*a* and 54*c* may be adjusted by loosening the screws, positioning the vertical member 54*b,* 54*c* and then tightening the screws. In this way, the effective width of member 54*b* can be adjusted to conform to the width of the door 2 on which the bracket 54 is mounted.

Figure 16:
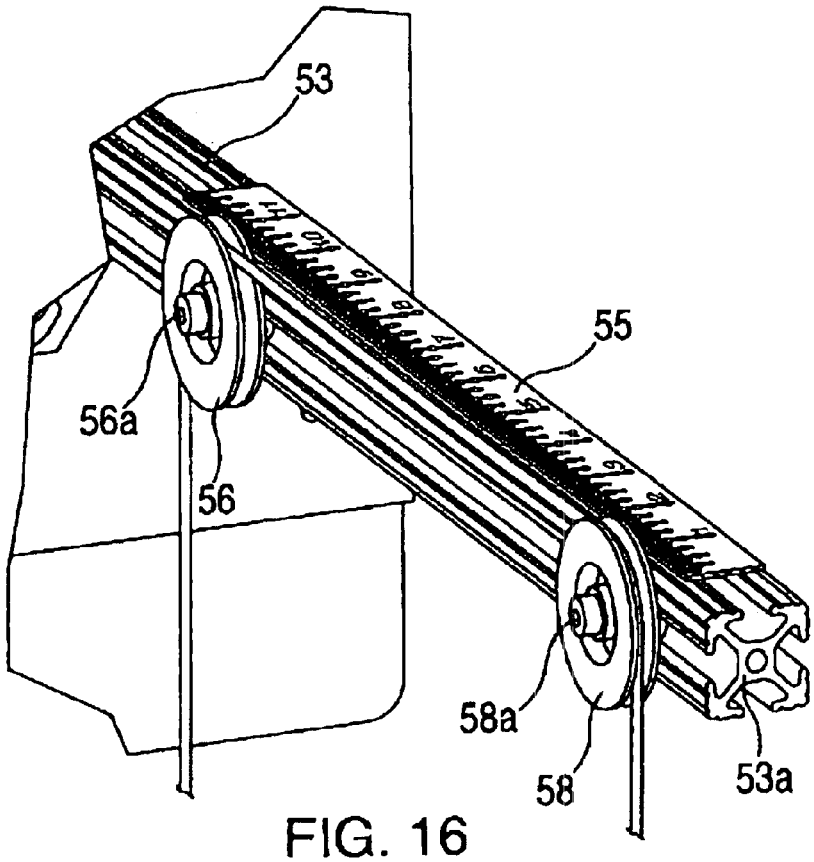
Figure 17:
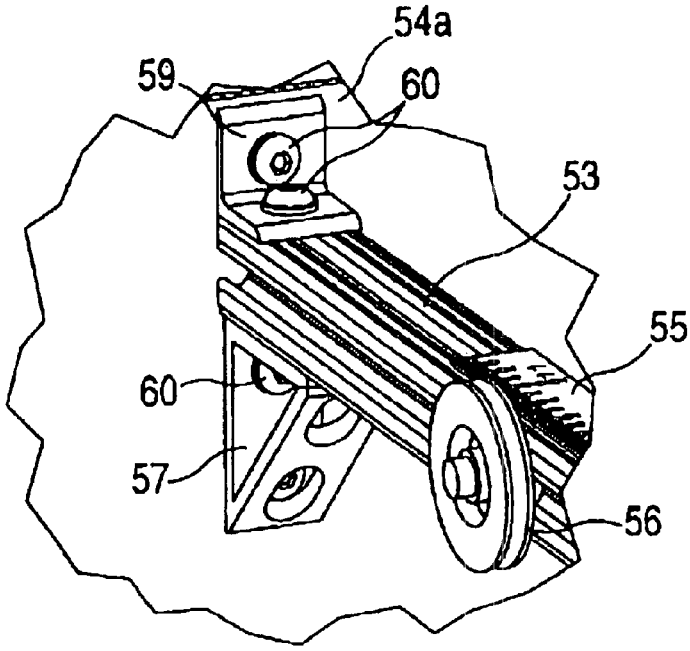

As seen best in FIGS. 15–17, the rail 53 is a slotted extrusion and is preferably provided with a scale 55 along the top. The pulleys 56 and 58 are preferably attached to the rail 53 by locking screws 56*a,* 58*a*. This allows the location of the pulleys to be adjusted relative to the scale 55. The pulleys are advantageously adjusted to accommodate different body types as well as different ranges of motion.

FIG. 17 illustrates how the rail 53 is attached to the vertical member 54*a*. In particular, the bottom of the rail 53 is connected to a gusset bracket 57 and the top of the rail is connected to an extruded support angle 59, preferably via cap screws 60.

As mentioned above, the apparatus of the invention has the capacity to provide the following forms of exercise: passive stretching of the posterior cervical/suboccipital muscles (i.e., muscles that rotate the head backward); active assisted exercise of the deep neck flexor muscles (i.e., muscles that rotate the head forward); active exercise of the deep neck flexors; resistive exercise of the deep neck flexors including isotonic exercise (both concentric and eccentric), isokinetic exercise and isometric exercise, and resistive exercise of the mid/lower trapezius and rhomboid muscles. In addition, the apparatus of the invention can be used to provide self-mobilization of the spinal articulations in the neck as well the stretching of individual muscle groups (e.g., levator scapulae, upper trapezium, etc.).

The apparatus is intended to be used as a physical therapy modality. Individuals desiring to use it will be expected to receive training by a licensed therapist. Once this has been accomplished, an individual may purchase a unit for home use. It will fit easily into a carry bag and is designed to be used at home, in the office, or in a hotel room when traveling.

The anticipated outcome of the aforementioned physiologic effects is a progressive lengthening of the head, neck, and torso. This has relevance to all individuals that demonstrate poor postural alignment except for those people who have irreversible changes due to a disease process of the spine.

Because improved postural alignment will enhance overall physical performance of the neck, trunk, and limbs, it is anticipated that many positive benefits will ensue for those who use the device on a regular basis.

There have been described and illustrated herein several embodiments of an exercise device for improving head, neck, and spinal alignment. While particular embodiments of the invention have been described, it is not intended that the invention be limited thereto, as it is intended that the invention be as broad in scope as the Art will allow and that the specification be read likewise. It will therefore be appreciated by those skilled in the Art that yet other modifications could be made to the provided invention without deviating from its spirit and scope as so claimed.

What is claimed is:

1. An exercise device for improving head, neck, and spinal alignment of a person when in a non-prone position, comprising:

a) a head harness removably attachable to a person's head and comprising a front portion and a rear portion and having a coupling at least at one of the front portion of said head harness so as to be positioned generally adjacent to above the center of the forehead of the person's head and the rear portion of said head harness so as to be positioned generally adjacent to the occipital region of the person's head;

b) a bracket adapted to be mounted on a support including at least one pulley; and c) a rope received over said at least one pulley and having a first end and a second end, said first end having at least one hand grip and said second end being releasably coupled to said head harness coupling, so that, upon pulling of said handgrip, said harness is lifted and, in turn the wearer's head is lifted and rotated forward if the rope is attached to a coupling at the rear portion of the head harness and the person's head is lifted and rotated rearwardly if the rope is attached to a coupling at the front of the head harness.

2. An exercise device according to claim 1, wherein said bracket is adapted to be mounted on the top of a door.

3. An exercise device according to claim 1, wherein said bracket is adapted to be mounted on a wall.

4. An exercise device according to claim 1, wherein said second end of said rope has a coupling member adapted to releasably couple with said head harness.

5. An excise device according to claim 4, wherein:

the relative location of said pulleys is adjustable.

6. An exercise device according to claim 1, wherein:

said head harness has a coupling at the front portion of the head harness and a coupling at the back portion of the head harness.

7. An exercise device according to claim 6, wherein:

said bracket includes a scale which indicates the relative location of said pulleys.

8. An exercise device according to claim 1, wherein:

said head harness has a coupling at the back portion of the head harness.

9. An exercise device according to claim 1, wherein:

said bracket has two pulleys.

10. An exercise device according to claim 9, wherein:

said head harness includes an over the top of the head strap.

11. An exercise device according to claim 9, wherein:

said head harness includes a substantially H-shaped member.

12. An exercise device according to claim 9, wherein:

said head harness includes a substantially X-shaped member.

13. An exercise device according to claim 12, wherein:

the effective length of said rope is adjustable.

14. An exercise device according to claim 9, wherein:

said head harness has a wishbone shaped member connecting the head strap and the chin strap.

15. An exercise device according to claim 1, wherein:

said head harness includes a forehead strap and a chin strap.

16. An exercise device according to claim 1, wherein:

said rope is adjustable in effective length.

17. An exercise device according to claim 1, wherein:

said rope has a Y configuration with two hand grips.

18. A method for improving a person's head, neck, and spinal alignment, comprising:

a) attaching a harness to the person's head;

b) coupling a rope to either the front or the back of the head harness;

c) attaching a bracket with at least one pulley to a support;

d) passing the rope over the pulley; and e) repeatedly pulling on the rope to effect an upward movement and rotation of the person's head while the person is in a non-prone position.

19. A method according to claim 18, wherein said support is a door.

20. An exercise device according to claim 1, wherein said bracket extends away from said support at a predetermined height and said pulley is spaced from said support such that a person may be positioned beneath said bracket with the person's back to the support and with said handgrip disposed in front of the person.

* * * * *